US006305422B1

(12) United States Patent
Grossman

(10) Patent No.: US 6,305,422 B1
(45) **Date of Patent: *Oct. 23, 2001**

(54) UNDERSINK FROZEN PIPE THAWING SYSTEM

(76) Inventor: Kurt L. Grossman, 8630 Twilight Tear La., Cincinnati, OH (US) 45249

( * ) Notice: Subject to any disclaimer, the term of this patent is extended or adjusted under 35 U.S.C. 154(b) by 0 days.

This patent is subject to a terminal disclaimer.

(21) Appl. No.: 09/516,998

(22) Filed: Mar. 1, 2000

Related U.S. Application Data

(60) Continuation-in-part of application No. 08/536,304, filed on Sep. 26, 1995, now Pat. No. 6,041,821, which is a division of application No. 08/192,171, filed on Feb. 4, 1994, now abandoned.

(51) Int. Cl.[7] ..... E03B 7/14

(52) U.S. Cl. ..... 138/33; 138/35; 219/229; 134/22.11; 134/5

(58) Field of Search ..... 138/32, 33, 35; 219/229, 201, 236; 134/166 C, 5, 22.11

(56) References Cited

U.S. PATENT DOCUMENTS

| | | | | |
|---|---|---|---|---|
| 168,352 | * | 10/1875 | Sloan | 138/35 |
| 458,503 | * | 8/1891 | Simpson | 138/35 |
| 501,744 | | 7/1893 | Streeper . | |
| 558,992 | | 4/1896 | Silver . | |
| 978,150 | * | 12/1910 | Gold | 138/32 |
| 3,275,803 | | 9/1966 | True . | |
| 3,764,779 | | 10/1973 | Kadoya et al. . | |
| 3,767,117 | | 10/1973 | Baker . | |
| 4,102,358 | | 7/1978 | Sherock . | |
| 4,110,597 | | 8/1978 | Elmore . | |
| 4,124,039 | | 11/1978 | St. Laurent . | |
| 4,194,536 | | 3/1980 | Stine et al. . | |
| 4,250,925 | | 2/1981 | Mast . | |
| 4,314,140 | | 2/1982 | Hughes . | |
| 4,423,311 | | 12/1983 | Varney, Sr. . | |
| 4,449,553 | | 5/1984 | Sullivan et al. . | |
| 4,575,614 | | 3/1986 | Hughes . | |
| 4,883,943 | | 11/1989 | Davis . | |
| 4,986,311 | | 1/1991 | Mikkelson . | |
| 5,193,587 | | 3/1993 | Miller, Jr. . | |
| 5,214,266 | | 5/1993 | Halone, Jr. . | |
| 5,289,561 | | 2/1994 | Costa Filho . | |
| 5,715,869 | * | 2/1998 | Patterson | 138/35 |
| 5,859,953 | * | 1/1999 | Nickless | 138/33 |
| 6,041,821 | * | 3/2000 | Grossman | 138/35 |

FOREIGN PATENT DOCUMENTS

| | | |
|---|---|---|
| 1178198 | 5/1959 | (FR) . |

* cited by examiner

*Primary Examiner*—James Hook

(57) ABSTRACT

A micro heater assembly (10) is provided with a micro heater (12) on the distal end (14) of an elongated support wire (16). Micro heater (12) is insertable into a normally water-carrying aperture (141) of an accessible pipe portion (68) under a valved outlet/water collecting appliance such as a sink (40) to reach a frozen section (202) of the branch line pipe (70) upstream of pipe portion (68) whereat to easily and reliably thaw pipe (70) from within safely and cost-effectively.

20 Claims, 3 Drawing Sheets

UNDERSINK FROZEN PIPE THAWING SYSTEM

RELATED APPLICATION

This application is a continuation-in-part of my application Ser. No. 08/536,304 filed Sep. 26, 1995, now allowed, U.S. Pat. No. 6,041,821 which is a divisional of my application Ser. No. 08/192,171 filed Feb. 4, 1994, now abandoned, both entitled Frozen Pipe Thawing System, and the disclosures of both of which are incorporated herein by reference in their entireties.

Background of the Invention

I. Field of the Invention

The present invention relates to a system and method for reliably and easily thawing frozen pipes in a safe and cost-effective manner, and more particularly to thawing branch line pipes such as those which feed kitchen and bathroom sinks.

II. Description of Prior Art

In many areas throughout the United States and other countries, the temperature in the wintertime, for example, gets so cold that water pipes that are near exterior walls tend to freeze up. Frozen pipes are not only an inconvenience, but if not attended to, could rupture leading to expensive and sometimes dangerous situations. Most often, the main water feed line into a dwelling or other structure is not the pipe that freezes up. Instead, the freeze usually occurs in a subsidiary or branch line pipe that is one of many branch lines feeding off the main line. These branch line pipes feed sinks, such as bathroom or kitchen sinks, which are often located adjacent an exterior wall, such that some length of the branch line pipe feeding that sink also runs near or is exposed to the cold of the exterior wall.

As will be appreciated, a typical sink includes cold and/or hot water lines which couple through respective turn-off valves to a faucet. Each branch line pipe usually has a portion that extends out of the floor or wall of the building and into a space below the sink, such as inside of a cabinet, such that the pipe portion is accessible under the sink without tearing into the floor or wall. That accessible portion of the branch line pipe couples directly to the inlet side of a turn-off valve which is also under the sink and inside the cabinet, for example. The outlet side of the turn-off valve couples to the faucet through a short feed tube under the sink to thereby provide water to the faucet. The accessible branch line pipe portion, turn-off valve and feed tube for each of the hot and/or cold water supplies thus define undersink plumbing components. The undersink plumbing components are under the sink, but outside the wall or floor from which the pipe portion projects, and are usually enclosed in the cabinet for ready access thereto. Unfortunately, the section of branch line pipes that tends to freeze is in the wall or ceiling (or below the floor) of the building upstream of the feed tube(s), turn-off valve(s), and accessible pipe portion(s) under the sink so as to not be readily accessible.

When there is a freeze in such a pipe section, the homeowner may be left with options that are not particularly desirable or safe. The homeowner could just "wait it out" and hope the pipe does not burst while waiting for the weather to warm up enough to thaw the pipe. This wait and see approach could be risky leaving the pipe vulnerable to rupture, not to mention the inconvenience of going without running water from that pipe for a possibly prolonged period of time. Another approach may be to attempt to indirectly thaw the frozen pipe section by applying heat to the adjacent floor, ceiling or wall, or to the accessible portion of the pipe under the sink, such as with a hair dryer or a torch. In these cases, either insufficient heat may be applied to actually cause the freeze to melt, or the danger of fire is greatly increased. A third alternative is to cut into the ceiling or wall of the house to expose the frozen section of the pipe to room air or to apply heat directly to the frozen section. Not only is this expensive and destructive, it leaves the homeowner exposed to a risk of fire.

Some systems have been proposed to alleviate frozen pipes, or to attempt to prevent their occurrence, such as shown in U.S. Pat. Nos. 4,986,311 to Mikkelson and 4,423,311 to Varney. In the Mikkelson patent, a hot water feed tube is coupled to the main water feed line and introduced into the water system of the house in an attempt to flush hot water from the upstream side of the water plumbing system to the downstream location of the freeze. The system of the Mikkelson patent is cumbersome and is believed to have many disadvantages. For example, water must be provided, yet the water lines may be frozen, and use of large quantities of hot water can be messy and undesirable. Moreover, the system may not work well to reach a freeze in a subsidiary or branch line pipe that is remote, and accessible only along a tortuous path, from the main water feed line, as is often the case with frozen branch line pipes.

The Varney patent proposes to add a permanent adaptor, apparently in the main water feed line and remotely upstream from the sinks, with a small heater inserted through the adaptor to heat the water as it travels downstream past the adaptor. The device of the Varney patent appears to be designed to be energized at all times during cold weather, with the hope of avoiding a freeze in the water line. The system of the Varney patent is also believed to have several drawbacks. For example, the system of the Varney patent appears to require power to the heater for extended periods of time, which could be costly and may unnecessarily warm the water, even in pipes that are to desirably carry cold water. Moreover, the permanent adaptor has a normally non-water carrying aperture for the heater element but which can present a source of leakage. Still further, as with the Mikkelson patent, the system of the Varney patent may be insufficient to reach and melt a freeze in pipe sections where freezes often occur, i.e., in the branch line pipes that feed sinks, as those sections are remote, and separated via a tortuous path, from the main water feed line.

The Mikkelson and Varney patent systems are thus not believed to be desirable or particularly useful in those typical situations of sink-feeding branch line pipe freezes. Hence, there is a need for a simple and reliable system and method by which to unfreeze frozen branch line pipes that feed sinks, such as kitchen or bathroom sinks.

SUMMARY OF THE INVENTION

The present invention provides a system and method for easily, reliably, safely and cost-effectively thawing frozen branch line pipes that feed sinks without the disadvantages of prior methods and systems. To this end, and in accordance with the principles of the present invention, access to the frozen pipe section is made from under the sink by exposing an aperture of the accessible pipe portion to atmosphere, which aperture normally carries water therethrough, is under the sink, and is downstream of the frozen section; inserting a micro heater through the aperture and upstream towards the frozen pipe section; and melting or thawing the freeze by the heating action of the micro heater. The pipe portion aperture may be the end of the pipe coupled to the inlet side of the turn-off valve, and may be exposed to atmosphere by uncoupling the pipe portion from the turn-off valve inlet side. Alternatively, the pipe portion aperture may be selectively exposed through the turn-off valve such as by uncoupling the feed tube from the outlet side of the turn-off valve or from the faucet such that the micro heater is to be snaked through the turn-off valve, or the feed tube and the turn-off valve, and into the pipe portion through the aperture thereof. After the branch line pipe section is sufficiently unfrozen or thawed, the micro heater is simply removed and the pipe portion aperture reconnected to carry water by reassembling the pipe portion, turn-off valve and/or feed tube, to reestablish the flow of water to the sink. The faucet may then be turned on and allowed to run to keep the water flowing so the pipe does not refreeze.

By virtue of the foregoing, there is thus provided a system and method for safely, easily, reliably, and cost-effectively thawing frozen branch line pipes that feed sinks without exposing the dwelling or residents thereof to unnecessary risk, complications or expense. These and other objects and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
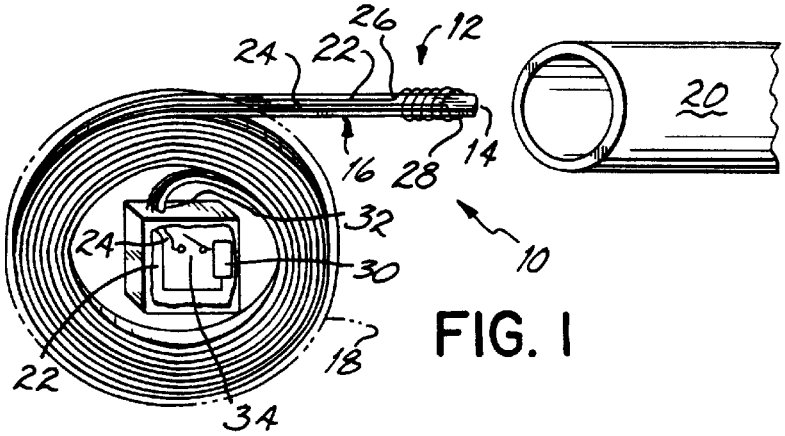
FIG. 1 is a perspective view of a micro heater assembly in accordance with the principles of the present invention.

With reference to FIG. 1 there is shown a micro heater assembly 10 having a micro heater 12 mounted to the distal end 14 of support 16. Support 16 may be an elongated electrician's wire puller, or other, preferably flexible but relatively stiff, support such as a coaxial cable or telephone cable. Support 16 is flexible enough to traverse bends and turns, but stiff enough not to just crumple up at a bend or turn. Support 16 may be coilably held on a roll or spool 18 and payed out as needed to snake micro heater 12 down through a pipe as will be described. Heater 12 and support 16 are sized small enough to fit easily within the interior of a typical water pipe such as pipe 20 representative of the ¼", ½" or other copper pipes typically in use in homes today. Thus, heater 12 and support 16 may be less than ¼", or preferably less than ⅛" wide or thick.

Micro heater 12 may be any small size heater such as an inch or so length of resistance or nichrome wire (such as from a portable hair dryer) wrapped around distal end 14 of support 16 and fastened thereto in any acceptable manner. Alternatively, heater 12 may be a ceramic or other electrically energizable heating element. If necessary, an insulative layer or web (not shown) may be provided between heater 12 and support 16 and also over heater 12 so it does not short out within the pipe. Upon application of electrical power to resistance wire heater 12, it will heat up. Sufficient length or number of turns of resistance wire and sufficient energy should be provided to cause heater 12 to heat up enough to melt a frozen section of pipe. To this end, insulated conductors or wires 22, 24 are electrically coupled to opposite ends 26, 28, respectively, of heater wire 12. Wires 22, 24 extend along support 16 to a source of power 30 at the proximal end 32 of support 16. Power source 30 could be one or more batteries or a transformer plugged into a conventional AC wall outlet (not shown). Wires 22, 24 could, alternatively, be heater wire as well for some of their length to facilitate thawing. An on/off switch 34 is provided in series with one or both of wires 22, 24 to turn heater 12 on or off as desired. Where support 16 is a coaxial cable or multi-wire cable, such as a telephone cable, the conductors within the cable may provide wires 22, 24.

Figure 2:
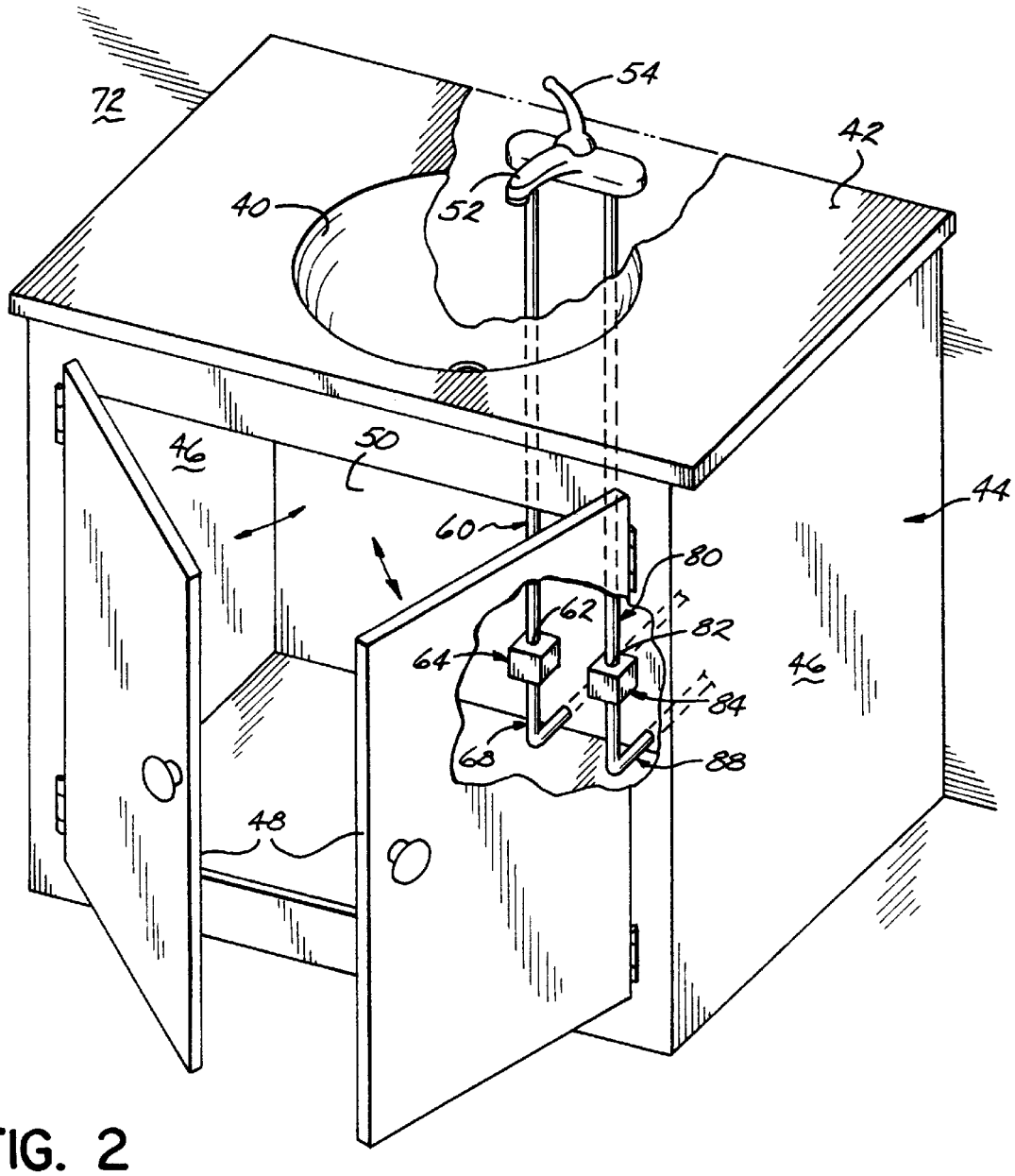
FIG. 2. is a perspective, partially broken away view of a sink and related undersink plumbing components with which the micro heater assembly of FIG. 1 may be used to unfreeze a frozen branch line pipe in accordance with the principles of the present invention.
Figure 3:
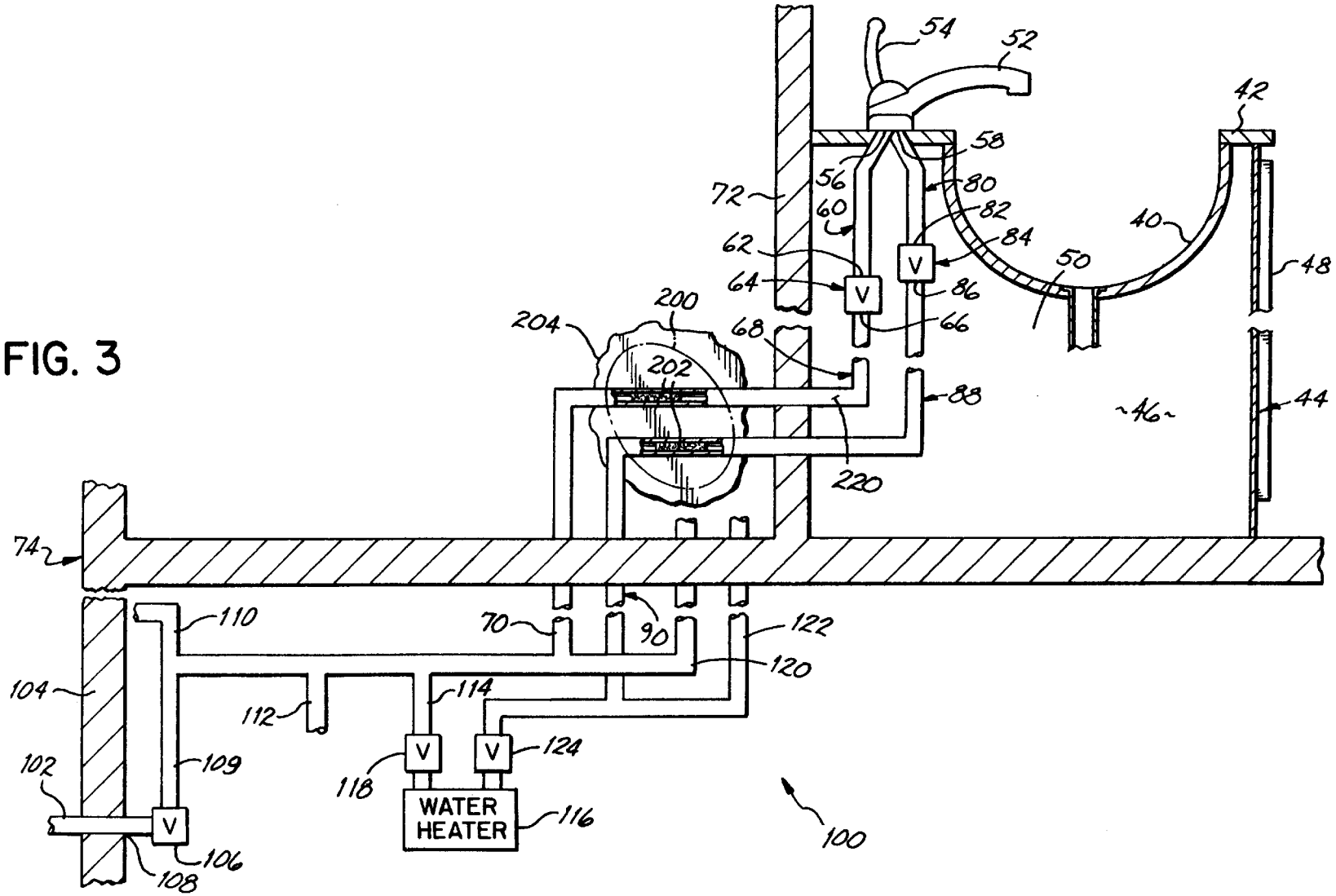
FIG. 3 is a schematic view of a plumbing system including the sink and plumbing components of FIG. 2 for explaining use of the micro heater assembly of FIG. 1 in accordance with the principles of the present invention.

With reference to FIG. 2, a sink 40 is supportably mounted to a countertop 42 which is supported on a cabinet 44 having at least sidewalls 46 and one or more doors 48 which cooperate with countertop 42 to enclose the space 50 below sink 40. With further reference to FIG. 3, sink 40 includes a faucet 52 which couples through faucet valve(s) 54 (which may be a single action system or two separate valve systems as is conventional) to respective cold and hot water taps 56, 58 accessible from within space 50 below sink 40. A first feed tube 60 couples the cold water tap 56 to the outlet end 62 of a first undersink turn-off valve 64, which in turn has its inlet end 66 coupled to the accessible portion 68 of a cold water branch line pipe 70 of a conventional plumbing water system 100 (FIG. 3). Pipe portion 68 extends into space 50 and below sink 40 from a structural surface 72, such as a wall or floor of the building 74 (FIG. 3) in which the sink 40 is contained so as to be accessible under sink 40 within cabinet 44. Similarly, a second feed tube 80 couples the hot water tap 58 to the outlet end 82 of a second undersink turn-off valve 84, which in turn has its inlet end 86 coupled to the accessible portion 88 of a hot water branch line pipe 90 of the conventional plumbing water system 100. Pipe portion 88 also extends into space 50 and below sink 40 such as from the structural surface 72.

As will be readily apparent, substantial lengths of the branch line pipes 70 and 90 extend behind the structural surfaces 72 of the building 74 and so are not readily accessible such as to the homeowner in the event of a freeze therein. In this regard, it will be appreciated that in a conventional plumbing system 100, such as shown schematically in FIG. 3, a main water line pipe 102 enters into the building 74 such as through a basement wall 104 thereof. There is usually a main shut-off valve 106 near the entry point 108 of pipe 102. Main water feed line continues through pipe 109 and branches off to supply water for several branch line pipes including hot and cold runs.

By way of example, first and second branch line pipes 110 and 112 may connect to pipe 109 downstream of main shut-off valve 106 to supply cold water to desired locations, examples of which may be an exterior sprinkler system (not shown) coupled to pipe 110 and a toilet or cold water tap (not shown) coupled to pipe 112. A third branch line pipe 114 extends from pipe 109 to supply a water heater 116, such as through a turn-off valve 118. Further branch line pipes, such as fourth and fifth branch line pipes 120 and 70 may extend off pipe 109 or one of the other branch line pipes to thus supply cold water to various locations (e.g., washing machines, sinks, toilets, outside faucets, etc.) throughout the building 74, with branch line pipe 70 being coupled to undersink turn-off valve 64 for sink 40 which may be on the first or second floor, for example, of the building 74. Similarly, there are hot water branch line pipes, such as sixth and seventh branch line pipes 122 and 90 to supply hot water from water heater 116 through turn-off valve 124 for various locations throughout the building, with branch line pipe 90 being coupled to undersink turn-off valve 84 for sink 40. While only a few representative branch line pipes are shown, conventional plumbing water system 100 may contain a greater or lesser number of branch line pipes depending upon the water needs of the building. It will be readily appreciated, however, that the branch line pipes often extend to locations that are remote from the main water line 102 and pipe 109, and involve many twists and turns therefrom to thus define a somewhat tortuous path between the destination (e.g., faucet 52) and the main water line 102 or pipe 109.

Figure 4:
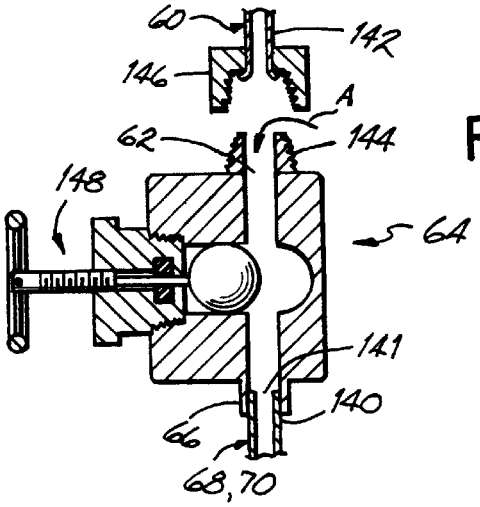
FIG. 4 is an exploded, schematic cross-sectional view of an undersink turn-off valve of FIGS. 2 and 3.

As seen in FIG. 4, the feed or inlet side 66 of valve 64 is usually soldered to the distal end 140 of accessible pipe portion 68 of water supply branch line pipe 70 for generally permanent attachment such that water will normally flow through pipe portion 68, aperture 141 of distal end 140 thereof, and into and through valve 64. On the other hand, the outlet side 62 of valve 64 is usually removably sealed to the proximal end 142 of feed tube 60 such as by cooperation of a threaded nipple 144 on the valve 64 and nut 146 about the feed tube proximal end 142. Often, valve stem 148 of valve 64 is removable. A similar arrangement is provided for pipe portion 88, valve 84 and feed tube 80.

When a section of one of the branch line pipes, such as section 200 (FIG. 3) of branch line pipe 70 which is upstream of accessible pipe portion 68, becomes too cold, it may freeze creating an ice block or frozen zone 202 within the pipe. Usually, this freezing occurs where the pipe is close to or adjacent to an exterior surface, such as a wall 204 of the dwelling 74 which is not warmed by the interior of the house sufficiently to avoid freezing. These locations usually are buried within a wall or ceiling of a house and are, therefore, not easily accessible. Also, they are usually sufficiently remote from any easily accessible portion of pipe, such as at shut-off valve 106 or turn-off valve 64, that the frozen section can not be easily, safely, reliably and cost-effectively unfrozen or thawed.

The present invention solves the frozen branch line pipe problem easily, safely, reliably and cost-effectively with micro heater assembly 10 as will now be described. To unblock freeze 202, micro heater 12 is to be placed into a pipe 70 through the accessible pipe portion 68 under sink 40. To this end, and with main shut-off valve 106 closed, if desired, so that water does not spew out once the pipe is unblocked, a normally water-carrying aperture of pipe portion 68 is to be exposed under sink 40. If cabinet 44 has a door 48 thereon, door 48 is first opened so that access is had to the space 50 under sink 40. With that access, the pipe portion aperture may be exposed to atmosphere in several ways. Pipe portion 68 could be cut open somewhere between structural surface 72 and valve 64 (such as at 220) so as to create an exposed end having such an aperture thereat. Or pipe end 140 could be removed from valve 64 to expose the aperture 141 at end 140. Still further, and advantageously, aperture 141 could be selectively exposed to atmosphere through valve 64. End 142 of feed tube 60 may be easily removed from valve 64 by unthreading nut 146 from nipple 14 such that access to pipe portion aperture 141 is via the outlet end 62 of valve 64. Alternatively, feed tube 60 could be accessed downstream of valve 64 (such as by cutting it midstream between valve 64 and tap 56 or by being disconnected from tap 56), so that access to aperture 141 is via feed tube 60 and valve 64. As a further alternative, valve stem 148 could be removed to expose aperture 141 to atmosphere via valve 64.

Where pipe aperture 141 is exposed to atmosphere by removal of tube 60 from valve 64, valve stem 142 is advantageously in the fully open position. Micro heater 12 is inserted into the outlet end 62 of valve 64 along the direction of arrow A in FIG. 4 and down through aperture 141 and towards the freeze 202. Alternatively, micro heater 12 is inserted through the pipe portion aperture directly if the aperture is opened up by cutting pipe section 68 or removing distal end 140 from valve 64, or is inserted through feed tube 60 and then through valve 64 where aperture 141 is exposed therethrough. In any case, with pressure applied by pushing on support 16 at a location rearwardly of heater 12, micro heater 12 is moved into and through pipe portion 68 towards area 200. Heater 12 is advantageously, although not required to be, moved until it runs up against frozen section 202. Micro heater 12 is preferably energized (such as by turning on switch 34 at supply 30 before or while it is being inserted into pipe portion 68) so that as it approaches section 200, any water in branch line pipe 70 along the way is being warmed to help open up the pipe as heater 12 travels. Heater 12 is held near or within location 200 until branch line pipe 70 is thawed or unfrozen enough to release or open up the ice in zone 200. Thereafter, micro heater 12 may be removed. To test if the pipe is thawed, micro heater 12 can be attempted to be inserted further down pipe 70 towards main line pipe 109. If heater 12 can be pushed a further distance, then blockage 202 may be assumed to be thawed. Preferably, micro heater 12 is kept in place for an extra period of time long enough to heat area 200 so that it will not refreeze during removal of micro heater 12 and restoring of the water system.

After thawing frozen portion 200, heater 12 is withdrawn from pipe 70, pipe portion 68, and, if involved, valve 64 and/or feed tube 60. The undersink plumbing components are then reconnected, such as by soldering the cut components or threadably reengaging the threaded components to restore the pipe portion aperture, such as aperture 141 so that it normally carries water therethrough, whereby to reestablish the water line connection to faucet 52. Door 48 of cabinet 44 may also then be closed. Main valve 106 is then reopened (if it was closed) and valve 54 of faucet 52 opened to allow water to run therethrough. Usually, maintaining a flow of water will prevent refreezing during the cold spell so that branch line pipe 70 will remain unblocked merely by leaving faucet 52 partially open until the weather warms up.

If desired, main valve 106 could be left open during the melting process so that water will immediately flow out of pipe portion 68 and/or valve 64 and feed tube 60 as the freeze 202 thaws.

In use, when it is necessary to thaw a frozen branch line pipe, access into the frozen pipe is made at a location downstream of the freeze and under the sink such as via, or in the vicinity of, the turn-off valve under the sink as above described with the micro heater 12. Heater 12 is then snaked toward and possible into the site of the blockage and the area heated by the action of heater 12 until the frozen pipe is thawed. Heater 12 is then withdrawn and the plumbing system restored so that there is now running water available.

Figure 5:
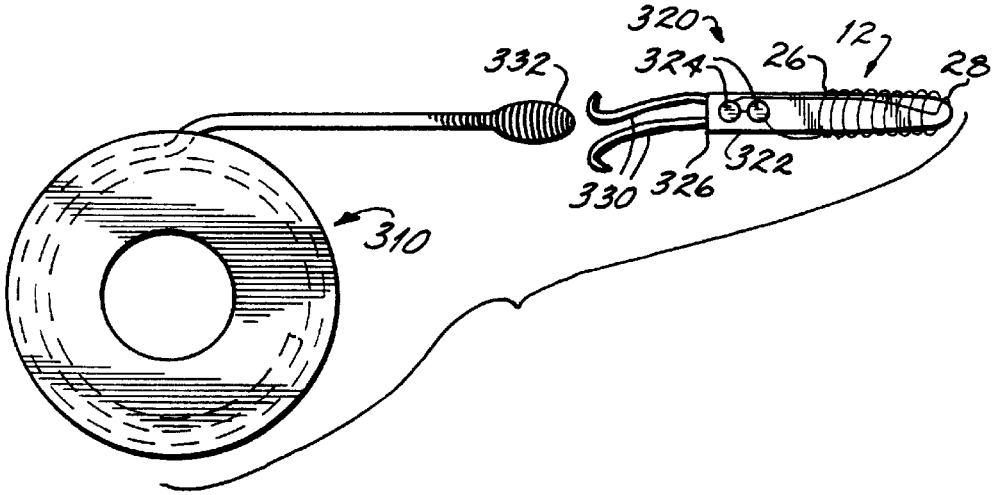
FIG. 5 is a disassembled elevational view of a self-contained micro heater assembly.

In some cases, it may be desirable to use a conventional plumber's snake 310 (FIG. 5) for moving heater 12 to the frozen zone 202. For this purpose, a self-contained micro heater assembly or cartridge 320 may be provided. Heater 320 includes micro heater 12 as before described mounted to a small support member 322. Also carried by support 322 are one or more batteries 324 (such as small watch batteries so they may fit within pipe 70). Batteries 324 are mounted with micro heater 12 and electrically connected to the ends 26, 28 of the heater wire 12 in any usual manner. A switch function may be provided by a selective connection of one end 26 or 28 of heater 12 to the batteries 324. Support 322 includes at its proximal end 326 a tie-band 330 which may be releasably secured to the distal end 332 of snake 310 by twisting band 330 into distal end 332. Other securing mechanisms or approaches may also be utilized as will be readily appreciated.

Use of micro heater cartridge assembly 320 is generally like that of assembly 12.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, heater 12 could be a chemically initiated heater element which eliminates the need for electrical power. In that event, the heater may be a flexible container with two compartments separated by a rupturable membrane with each compartment carrying a respective chemical. When ready for use, the container is flexed to rupture the membrane so the two chemicals can react to create the desired heat. Although such a device might be limited to a one-time use, it may serve as a micro heater cartridge like FIG. 5, for example, but which is disposable. Also, it may be that not only is cold water branch line pipe 70 frozen within area 200, but a portion of hot water branch line pipe 90 adjacent pipe 70 in area 200 may also be frozen thereat. By placing heater 12 at the zone 202 of pipe 70, it may also be possible to generate enough heat to warm the adjacent portion of pipe 90 to then thaw pipe 90 as well without separately inserting a heater 12 into pipe 90. Still further, while the present invention has been described with reference to a kitchen or bathroom sink, it will be appreciated that the present invention could be applied to other valved outlet/water collecting appliances, such as a toilet. In this regard, a sink ordinarily can be used to collect water that is selectively allowed to pass out of the valved faucet, just as a water closet of a toilet can be used to collect water that is selectively allowed to pass out of the flush valve thereof. Similarly, the flush valve is coupled to an accessible portion of a branch line pipe through an underappliance shut-off valve like the undersink shut-off valve, and which are under the appliance and readily accessible downstream of the structural surface from which the pipe portion extends. It will also be understood, in view of the foregoing, that the term "micro heater" is meant to refer to any self-defined device or structure having a heat generating portion small enough to fit within a pipe to be thawed. The invention in its broadest aspects is therefore not limited to the specific details, representative apparatus and method, and illustrative examples shown and described. Accordingly, departures may be made from such details without departing from the spirit or scope of the general inventive concept.

Having described the invention, what is claimed is:

1. A method of thawing a frozen section of a branch line pipe, the branch line pipe being normally adapted to supply water to a faucet associated with a sink and being remote and downstream from a main water feed line, wherein the branch line pipe includes an accessible pipe portion under the sink and extending out from a structural surface situated near the sink and downstream of the frozen section of the branch line pipe, with the accessible pipe portion being coupled through an undersink turn-off valve to the faucet, the method comprising:

accessing the frozen pipe section from an area defined between under the sink and the structural surface near the sink from which the accessible pipe portion extends by exposing an aperture of the accessible pipe portion to atmosphere at a location that is in the area so defined, which aperture normally carries water therethrough, is under the sink between the sink and the structural surface, and is downstream of the frozen section;

inserting a micro heater through the pipe portion aperture and upstream towards the frozen pipe section;

thawing the freeze by the heating action of the micro heater; and removing the micro heater through the pipe portion aperture.

2. The method of claim 1 wherein the sink is supportably mounted to a cabinet having a door and with the accessible pipe portion and undersink turn-off valve being within the cabinet, the method further comprising first opening the door to access the pipe portion.

3. The method of claim 2 further comprising closing the door after removal of the micro heater.

4. The method of claim 1 further comprising moving the micro heater within the pipe to the frozen section.

5. The method of claim 1 further comprising, after the micro heater is removed, restoring the pipe aperture so that it normally carries water therethrough.

6. The method of claim 1 further comprising cutting the pipe portion between the undersink turn-off valve and the structural wall whereby to create a pipe portion aperture exposed to atmosphere, and inserting the micro heater through the aperture created by the cutting.

7. The method of claim 6 further comprising, after the micro heater is removed, restoring the pipe aperture so that it normally carries water therethrough.

8. The method of claim 1 further comprising disconnecting the pipe portion from the undersink turn-off valve so as to expose a distal end of the pipe portion defining the aperture through which the micro heater is inserted.

9. The method of claim 8 further comprising, after the micro heater is removed, restoring the pipe aperture so that it normally carries water therethrough.

10. The method of claim 1, the undersink turn-off valve having in inlet side connected to an end of the pipe portion carrying the aperture, the undersink turn-off valve having an outlet side coupled to the faucet, the method further comprising exposing the undersink turn-off valve outlet side to atmosphere whereby to expose the pipe portion aperture to atmosphere through the undersink turn-off valve, and inserting the micro heater through the undersink turn-off valve outlet side and then through the pipe portion aperture.

11. The method of claim 1, the undersink turn-off valve having in inlet side connected to an end of the pipe portion carrying the aperture, the undersink turn-off valve having an outlet side coupled to a feed tube fluidicly coupled to the faucet, the method further comprising cutting the feed tube between the undersink turn-off valve and the faucet whereby to expose the pipe portion aperture to atmosphere through the feed tube and the undersink turn-off valve, and inserting the micro heater through the feed tube at the cutting, through the undersink turn-off valve outlet side, and then through the pipe portion aperture.

12. The method of claim 1, the undersink turn-off valve having in inlet side connected to an end of the pipe portion carrying the aperture, the undersink turn-off valve having an outlet side coupled to a feed tube fluidicly coupled to the faucet, the method further comprising disconnecting the feed tube from the undersink turn-off valve outlet side whereby to expose the pipe portion aperture to atmosphere through the undersink turn-off valve, and inserting the micro heater through the undersink turn-off valve outlet side, and then through the pipe portion aperture.

13. The method of claim 1, the undersink turn-off valve having in inlet side connected to an end of the pipe portion carrying the aperture, the undersink turn-off valve having an outlet side coupled to a feed tube fluidicly coupled to the faucet, the method further comprising disconnecting the feed tube from the faucet whereby to expose the pipe portion aperture to atmosphere through the undersink turn-off valve and the feed tube, and inserting the micro heater through the feed tube, through the undersink turn-off valve outlet side, and then through the pipe portion aperture.

14. The method of claim 1 further comprising accessing the undersink turn-off valve whereby to expose the pipe portion aperture to atmosphere through the undersink turn-off valve, and inserting the micro heater through the undersink turn-off valve, and then through the pipe portion aperture.

15. A method of thawing a frozen section of a first branch line pipe situated adjacent to a second branch line pipe, the second branch line pipe being normally adapted to supply water to a faucet associated with a sink and being remote and downstream from a main water feed line, wherein the second branch line pipe includes an accessible pipe portion under the sink and extending out from a structural surface downstream of a target section of the second branch line pipe adjacent the frozen section of the first branch line pipe, with the accessible pipe portion being coupled through an undersink turn-off valve to the faucet, the method comprising:

accessing the target section of the second branch line adjacent the frozen pipe section from under the sink by exposing an aperture of the accessible pipe portion to atmosphere, which aperture normally carries water therethrough, is under the sink, and is downstream of the target section;

inserting a micro heater through the pipe portion aperture and upstream towards the target section;

thawing the frozen section of the first branch line pipe by the heating action of the micro heater within the second branch line pipe; and removing the micro heater through the pipe portion aperture.

16. The method of claim 15 wherein the sink is supportably mounted to a cabinet having a door and with the accessible pipe portion and undersink turn-off valve being within the cabinet, the method further comprising first opening the door to access the pipe portion.

17. The method of claim 16 further comprising closing the door after removal of the micro heater.

18. The method of claim 15 further comprising, after the micro heater is removed, restoring the pipe aperture so that it normally carries water therethrough.

19. A method of thawing a frozen section of a branch line pipe, the branch line pipe being normally adapted to supply water to a valved outlet/water collecting appliance and being remote from a main water feed line, wherein the branch line pipe includes an accessible pipe portion under the appliance and extending out from a structural surface near the appliance and downstream of the frozen section of the branch line pipe, with the accessible pipe portion being coupled through a turn-off valve to the appliance, the method comprising:

accessing the frozen pipe section from an area defined between under the appliance and the structural surface near the appliance by exposing an aperture of the accessible pipe portion to atmosphere at a location that is in the area so defiend, which aperture normally carries water therethrough, is under the appliance between the appliance and the structural surface, and is downstream of the frozen section;

inserting a micro heater through the pipe portion aperture and upstream towards the frozen pipe section;

thawing the freeze by the heating action of the micro heater; and removing the micro heater through the pipe portion aperture.

20. The method of claim 19 further comprising, after the micro heater is removed, restoring the pipe aperture so that it normally carries water therethrough.

* * * * *